US006820658B2

(12) United States Patent
Brennan et al.

(10) Patent No.: US 6,820,658 B2
(45) **Date of Patent: *Nov. 23, 2004**

(54) METHOD AND APPARATUS FOR FILLING CONTAINERS

(75) Inventors: John Brennan, Berkshire (GB); Roger Matthews, Tivirton (GB); Stephen Metcalf, Loughborough (GB)

(73) Assignee: AstraZeneca AB, Sodertalje (SE)

( * ) Notice: Subject to any disclaimer, the term of this patent is extended or adjusted under 35 U.S.C. 154(b) by 0 days.

This patent is subject to a terminal disclaimer.

(21) Appl. No.: 10/406,241

(22) Filed: Apr. 4, 2003

(65) Prior Publication Data

US 2003/0201027 A1 Oct. 30, 2003

Related U.S. Application Data

(63) Continuation of application No. 09/819,859, filed on Mar. 29, 2001, now abandoned.

(30) Foreign Application Priority Data

Apr. 21, 1998 (SE) ..... 9801398-0
Apr. 21, 1999 (SE) ..... PCT/SE99/00650

(51) Int. Cl.[7] ..... B65B 3/04
(52) U.S. Cl. ..... 141/3; 141/20; 141/65; 141/348; 141/349; 53/284.5; 53/470
(58) Field of Search ..... 53/470, 473, 284.5; 141/3, 18, 20, 65, 348, 349

(56) References Cited

U.S. PATENT DOCUMENTS

| | | | |
|---|---|---|---|
| 2,505,799 A | 5/1950 | Smith | |
| 2,947,904 A | 8/1960 | Focht | |
| 2,958,170 A | 11/1960 | Mayer, Jr. | |
| 2,963,834 A | 12/1960 | Stanley et al. | |
| 3,186,451 A | 6/1965 | Stanley | |
| 3,745,741 A | 7/1973 | Cunningham et al. | |
| 3,755,985 A | 9/1973 | Rait et al. | |
| 3,995,666 A | 12/1976 | Michaels | |
| 4,917,156 A | 4/1990 | Varlet | |
| 4,999,976 A | 3/1991 | Smith | |
| 5,345,980 A | 9/1994 | Burt et al. | |
| 6,691,746 B2 * | 2/2004 | Brennan et al. | 141/3 |

FOREIGN PATENT DOCUMENTS

| | | |
|---|---|---|
| EP | 0056701 A2 | 7/1982 |
| EP | 0 419 261 A1 | 3/1991 |
| EP | 633 190 | 1/1995 |
| NO | 119265 B | 4/1970 |

* cited by examiner

*Primary Examiner*—Eric Compton
(74) *Attorney, Agent, or Firm*—Nixon & Vanderhye

(57) ABSTRACT

A filling apparatus for, a filling system for and a method of introducing into a container a suspension or solution of a substance, in particular a pharmaceutical substance, in a propellant under pressure, the filling apparatus comprising: a main body (4) including a passageway (20) for communicating, in use, with a valve stem (144) extending from a head (141) of a body (139) of a container (138), the container (138) comprising a metering chamber (143) selectively communicatable by the valve stem (144) with the atmosphere and a storage chamber (140) defined by the body (139); a fill actuator (7) comprising a filling valve assembly (29) in communication with the passageway (20) for selectively introducing thereinto propellant under pressure containing a substance in a suspension or solution; an exhaust actuator (10) comprising an exhaust valve assembly (48) in communication with the passageway (20) for selectively exhausting therefrom propellant under pressure containing substance; and a container-engaging body (16) in communication with the passageway (20) for receiving, in use, the head (141) of the body (139) of the container (138), the container-engaging body (16) being movable relative to the main body (4) so as thereby to cause the valve stem (144) of the container (138) to be selectively positioned in an extended closed position, a depressed open position or an intermediate position therebetween, in which intermediate position the metering chamber (143) of the container (138) is closed to the atmosphere.

17 Claims, 13 Drawing Sheets

METHOD AND APPARATUS FOR FILLING CONTAINERS

This application is a continuation of application Ser. No. 09/819,859, filed Mar. 29, 2001, now abandoned, the entire content of which is hereby incorporated by reference in this application.

The present invention relates to a filling apparatus for, a filling system for and a method of introducing into a container a suspension or solution of a substance, in particular a pharmaceutical substance, in a propellant under pressure. Most particularly, the present invention relates to a filling head included in a line in which a propellant under pressure containing a substance in a suspension or solution is circulated, with the filling head being brought into and out of communication with containers to be filled.

BACKGROUND OF THE INVENTION

Containers for holding a suspension or solution of a pharmaceutical substance in a propellant under pressure are well known. One such known container comprises a body which defines a storage chamber, a valve stem which extends from a head of the body and a metering chamber which is selectively communicatable by the valve stem with the atmosphere and the storage chamber; the valve stem providing, via an L-shaped conduit which extends between the free end and the side wall thereof, the outlet of the container through which metered doses of propellant containing pharmaceutical substance are delivered. The valve stem is axially displaceable between a first, extended position in which the metering chamber, and hence the container, is closed to the atmosphere since the L-shaped conduit is disposed wholly outside the metering chamber, and a second, depressed position, in which the metering chamber is in communication with the outlet provided by the L-shaped conduit in the valve stem and through which a metered dose of propellant containing pharmaceutical substance is delivered. The container is filled with the valve stem in the depressed position, with the propellant containing pharmaceutical substance being forced downwardly through the L-shaped conduit in the valve stem, through the metering chamber and into the storage chamber defined by the body of the container.

EP-A-0419261 discloses a filling system for introducing into a container a suspension or solution of a pharmaceutical substance in a propellant under pressure, which filling system includes a filling apparatus that prevents the escape of pharmaceutical substance into the atmosphere. In this filling system the filling apparatus is configured to be flushed by a volume of high pressure propellant while still in fluid communication with the container so that the propellant under pressure containing pharmaceutical substance which is remaining in the filling apparatus after filling the container with the same is flushed through into the container prior to withdrawal of the filling apparatus from the container. This configuration does, however, require additional propellant to be introduced into the container to achieve the flush. Moreover, following the flushing action, propellant under pressure present in the valve stem can escape to the atmosphere.

SUMMARY OF THE INVENTION

The present invention in at least one preferred aspect aims to provide an improved filling apparatus which at least partially overcomes the above-mentioned problems.

The present invention also aims to provide a method and filling system which are configured to fill a container without requiring the release of propellant alone or propellant containing pharmaceutical substance directly to the atmosphere.

The present invention provides a filling apparatus for introducing into a container a suspension or solution of a substance, in particular a pharmaceutical substance, in a propellant under pressure, comprising: a main body including a passageway for communicating, in use, with a valve stem extending from a head of a body of a container, the container comprising a metering chamber selectively communicatable by the valve stem with the atmosphere and a storage chamber defined by the body; a fill actuator comprising a filling valve assembly in communication with the passageway for selectively introducing thereinto propellant under pressure containing a substance in a suspension or solution; an exhaust actuator comprising an exhaust valve assembly in communication with the passageway for selectively exhausting therefrom propellant under pressure containing substance; and a container-engaging body in communication with the passageway for receiving, in use, the head of the body of the container, the container-engaging body being movable relative to the main body so as thereby to cause the valve stem of the container to be selectively positioned in an extended closed position, a depressed open position or an intermediate position therebetween, in which intermediate position the metering chamber of the container is closed to the atmosphere.

Preferably, the filling apparatus further comprises biasing means for biasing the container-engaging body away from the main body.

More preferably, the biasing means comprises at least one compression spring disposed between the main body and the container-engaging body.

Preferably, the main body includes an outwardly-extending part through which the passageway extends and which is sealingly received within a bore in the container-engaging body.

More preferably, the filling apparatus further comprises an annular seal disposed at the distal end of the outwardly-extending part of the main body, which seal is, in use, abutted by the distal end of the valve stem of the container.

Preferably, the container-engaging body includes a chamber of greater radial dimension than the valve stem of the container into which, in use, extends the valve stem of the container and a conduit in communication with the chamber for feeding a pressurised fluid thereto.

Preferably, the container-engaging body includes an annular seal disposed about a lower end of the chamber against which, in use, is abutted the head of the body of the container which surrounds the valve stem thereof. More preferably, the annular seal comprises an O-ring.

Preferably, opposing surfaces of the main body and the container-engaging body include one or the other of at least one projection and at least one recess, whereby, when the main body and the container-engaging body are moved together, the at least one projection is engaged within the at least one recess.

The present invention also extends to a filling system for introducing into a container a suspension or solution of a substance, in particular a pharmaceutical substance, in a propellant under pressure incorporating the above-described filling apparatus.

The present invention further provides a method of introducing into a container a suspension or solution of a substance, in particular a pharmaceutical substance, in a propellant under pressure, comprising the steps of: providing a container comprising a body defining a storage chamber, a valve stem extending from a head of the body and a metering chamber selectively communicatable by the valve stem with the atmosphere and the storage chamber, the valve stem having an outlet opening and a inlet opening and being movable between an extended closed position in which the inlet opening is located outside the body and a depressed open position in which the inlet opening is located within the body; communicating the outlet opening of the valve stem of the container with a passageway in a main body of a filling apparatus, the filling apparatus comprising a fill actuator comprising a filling valve assembly for selectively introducing into the passageway propellant under pressure containing a substance, in particular a pharmaceutical substance, in a suspension or solution and an exhaust actuator comprising an exhaust valve assembly for selectively exhausting from the passageway propellant under pressure containing substance; depressing the valve stem of the container so as to provide a communication path to the storage chamber thereof; opening the filling valve assembly thereby to fill the storage chamber of the container with propellant under pressure containing a substance, in particular a pharmaceutical substance, in a suspension or solution; closing the filling valve assembly; moving the valve stem of the container to an intermediate position between the depressed open position and the extended closed position, in which intermediate position the metering chamber of the container is closed to the atmosphere and the inlet opening in the valve stem of the container is located outside the body thereof; and opening the exhaust valve assembly to enable propellant under pressure containing substance in the passageway and the valve stem of the container to exhaust.

Preferably, the filling apparatus further comprises a container-engaging body which is movably disposed to the main body thereof and is configured to receive the head of the body of the container which includes the valve stem, and the method further comprises the step of biasing the container-engaging body away from the main body of the filling apparatus.

More preferably, the main body of the filling apparatus includes an outwardly-extending part through which the passageway extends and which is sealingly received within a bore in the container-engaging body.

Still more preferably, the method further comprises the step of sealing the distal end of the outwardly-extending part of the main body against the distal end of the valve stem of the container.

Preferably, the method further comprises the step of surrounding the part of the valve stem of the container which includes the inlet opening and extends from the body of the container with a pressurised fluid at least when the exhaust valve assembly is opened to exhaust propellant under pressure containing substance from the passageway and the valve stem of the container.

Preferably, the pressurised fluid is at a pressure greater than the vapour pressure of the propellant under pressure containing substance.

In a preferred embodiment the fluid is a gas. Preferably, the gas is one of air or nitrogen.

BRIEF DESCRIPTION OF THE DRAWINGS

A preferred embodiment of the present invention will now be described hereinbelow by way of example only with reference to the accompanying drawings, in which.

DETAILED DESCRIPTION OF THE PREFERRED EMBODIMENTS

Figure 1:
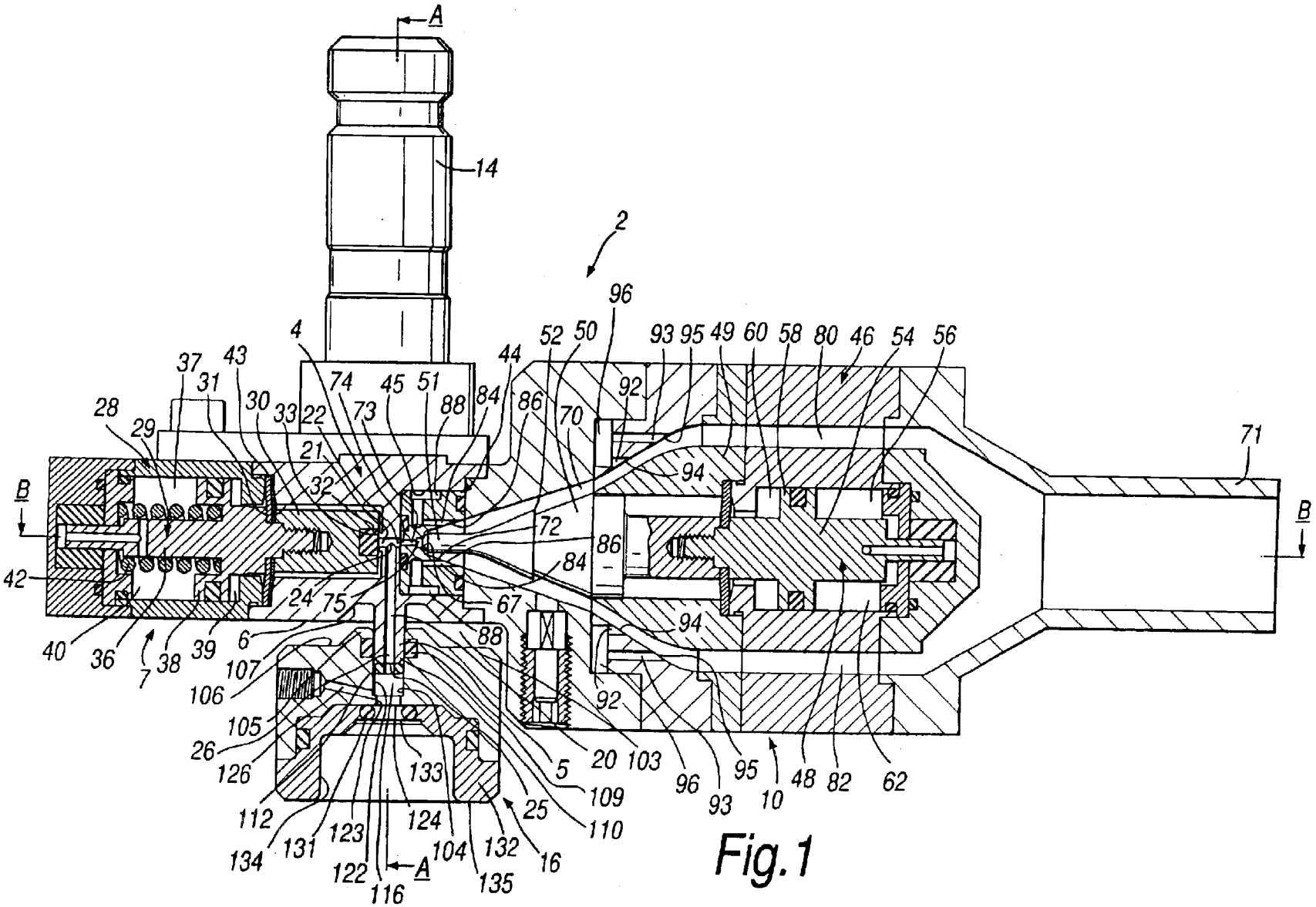
FIG. 1 illustrates a part-sectional side view of a filling head in accordance with a preferred embodiment of the present invention.
Figure 2:
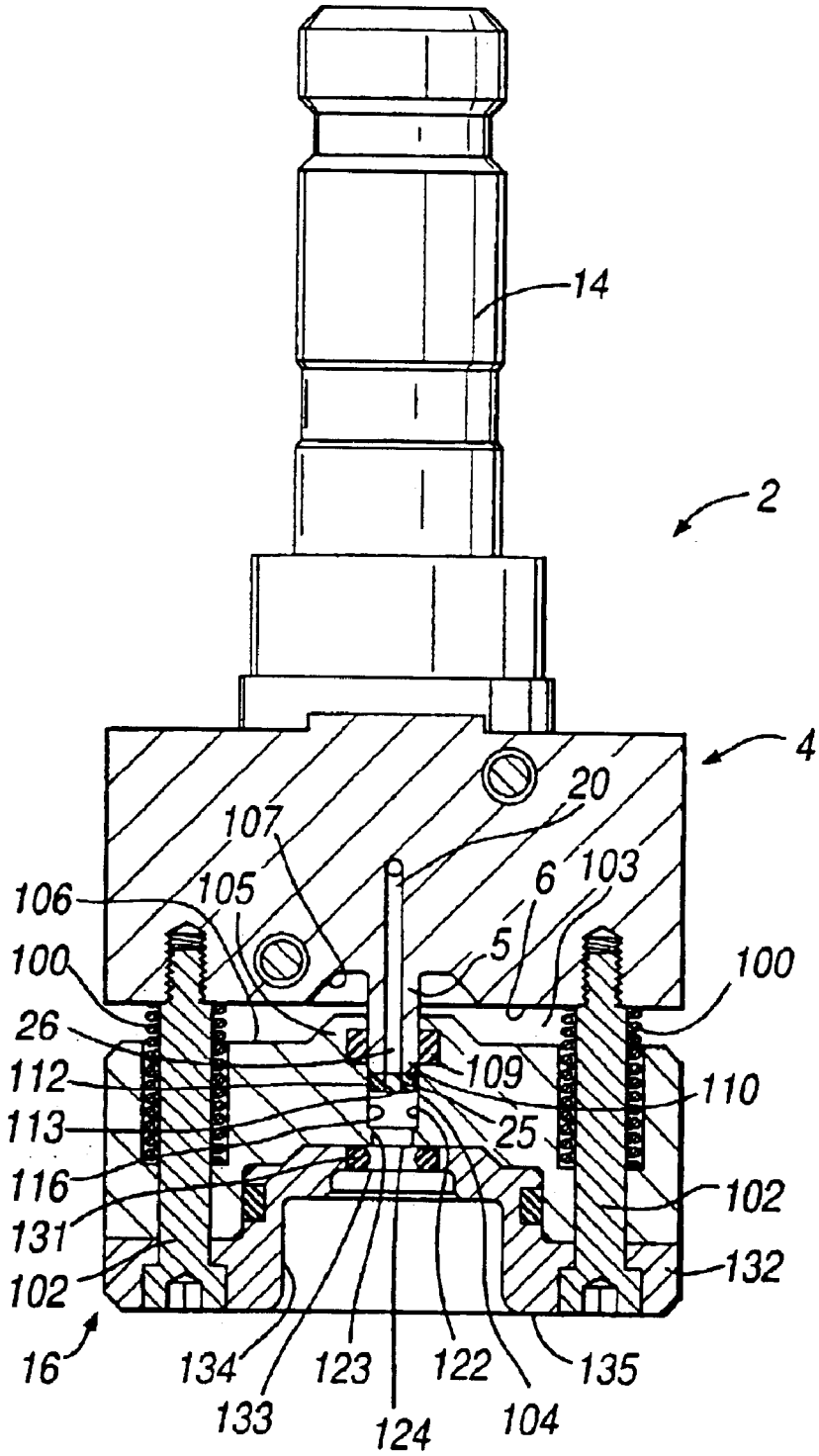
FIG. 2 illustrates a vertical sectional view (along section A—A) of the filling head of FIG. 1.
Figure 3:
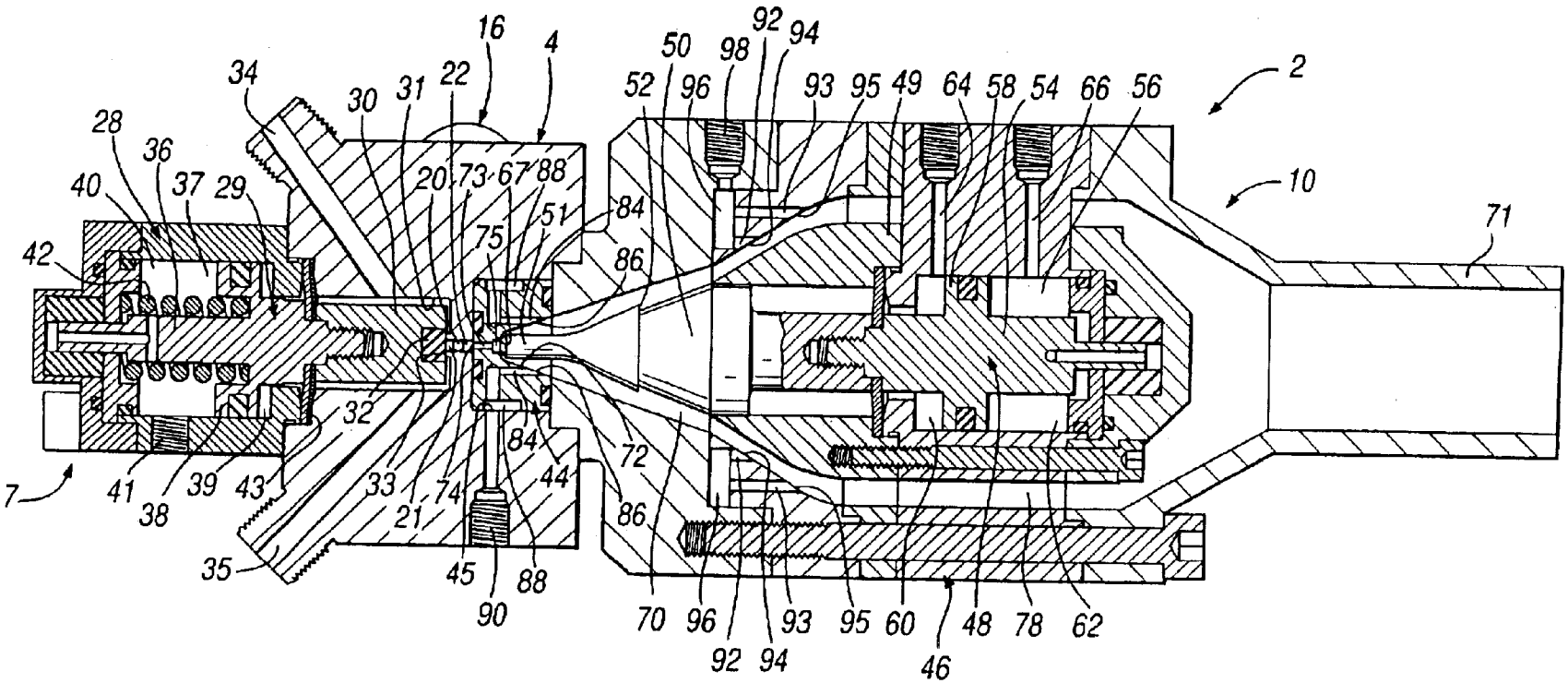
FIG. 3 illustrates a horizontal sectional view (along section B—B) of the filling head of FIG. 1.
Figure 4:
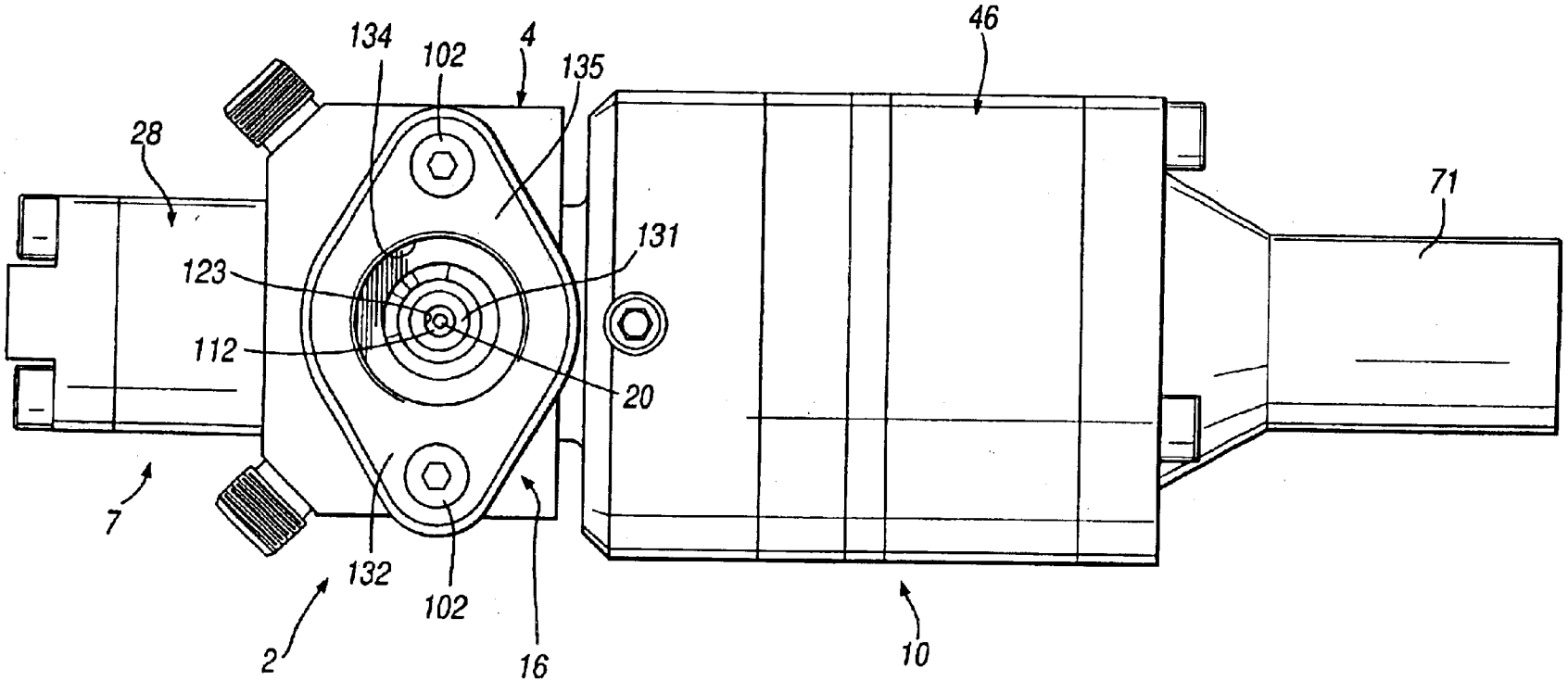
FIG. 4 illustrates an underneath plan view of the filling head of FIG. 1.

FIGS. 1 to 5 illustrate a filling head 2 in accordance with a preferred embodiment of the present invention.

The filling head 2 comprises a main body 4 which includes a downwardly-extending part 5 that extends from a lower surface 6 thereof, a fill actuator 7 disposed to one lateral side of the main body 4 and an exhaust actuator 10 disposed to the opposite lateral side of the main body 4. The filling head 2 further comprises an actuating mandrel 14 disposed to and above the main body 4 by which the filling head 2 is moved vertically. The filling head 2 still further comprises a slide body 16 for receiving a container to be filled which is mounted to the downwardly-extending part 5 of the main body 4 so as to be vertically movable relative thereto.

The main body 4 includes a vertically-oriented passageway 20 which is located substantially centrally therein and includes first and second horizontally-opposed openings 21, 22 at the upper end 24 thereof and a third opening 25 at the lower end 26 thereof which is located in the downwardly-extending part 5. The first and second openings 21, 22 communicate respectively with the fill actuator 7 and the exhaust actuator 10.

The fill actuator 7 comprises a housing 28 and a filling valve assembly 29 which is movably disposed thereto. The filling valve assembly 29 comprises a filling valve stem 30 which is slideably disposed within an annular chamber 31 in the main body 4 and includes a valve sealing end 32 which seals against a valve seat 33 that defines the first opening 21 of the passageway 20 in the main body 4. The chamber 31 includes an inlet conduit 34 and an outlet conduit 35 formed in the main body 4 on opposing lateral sides of the chamber 31. The filling valve assembly 29 further comprises a reciprocally movable filling valve member 36 which is axially coupled to the filling valve stem 30 and is sealingly disposed within an annular chamber 37 defined in the housing 28. The filling valve member 36 includes a radially outwardly-extending part 38 which sealingly divides the chamber 37 into first and second chamber parts 39, 40, the first chamber part 39 being near to the filling valve stem 30 and the second chamber part 40 being remote from the filling valve stem 30. The housing 28 includes a conduit 41 which communicates with the second chamber part 40 of the chamber 37 and is for connection to a source of a pressurised fluid. The filling valve assembly 29 yet further comprises biasing means 42, in this embodiment a compression spring, for biasing the filling valve member 36 and hence the filling valve stem 30 into the chamber 31 in the main body 4. The application/withdrawal of fluid pressure via the conduit 41 introduces/withdraws fluid from the second chamber part 40 of the chamber 37, thereby causing sliding movement of the filling valve member 36 in the chamber 37, and thereby sliding movement of the filling valve stem 30 in the chamber 31. In this way, the valve sealing end 32 of the filling valve stem 30 can be moved into and out of engagement with the valve seat 33 that communicates with the first opening 21 of the passageway 20 in the main body 4. The chamber 31 is sealed at the end thereof remote from the valve seat 33 and at the junction of the filling valve member 36 and the filling valve stem 30 by a flexible annular seal 43 that surrounds the filling valve stem 30.

The exhaust actuator 10 comprises a valve block 44 which is disposed in a cavity 45 in the main body 4, a housing 46 which is connected to the valve block 44 and an exhaust valve assembly 48 which is movably disposed within the housing 46.

The housing 46 comprises an annular support sleeve 49 and the exhaust valve assembly 48 comprises an exhaust valve stem 50 which includes a valve sealing end 51 and is slideably disposed in the support sleeve 49. The exhaust valve stem 50 is generally conical in shape, and increases in diameter away from the valve sealing end 51. In this embodiment the exhaust valve stem 50 includes a peripheral ridge 52 which acts to reduce the retention of substance thereon. The exhaust valve assembly 48 further comprises a reciprocally movable exhaust valve member 54 which is axially coupled to the exhaust valve stem 50 and is sealingly disposed within an annular chamber 56 in the support sleeve 49. The exhaust valve member 54 includes a radially outwardly-extending central part 58 which sealingly divides the chamber 56 into first and second chamber parts 60, 62, the first chamber part 60 being near to the exhaust valve stem 50 and the second chamber part 62 being remote from the exhaust valve stem 50. The support sleeve 49 includes first and second conduits 64, 66 for connection to a source of a pressurised fluid, each conduit 64, 66 communicating with a respective one of the first and second chamber parts 60, 62 of the chamber 56. Application of fluid pressure via one of the conduits 64, 66 introduces fluid into a respective one of the first and second chamber parts 60, 62 of the chamber 56, thereby causing sliding movement of the exhaust valve member 54 in the chamber 56, and thereby sliding movement of the exhaust valve stem 50 in the support sleeve 49. In this way, the valve sealing end 51 of the exhaust valve stem 50 can be moved into and out of engagement with an exhaust valve seat 67 provided by the valve block 44. The housing 46 further includes a generally annular chamber 70 in which the support sleeve 49 and the exhaust valve stem 50 are located, with the part of the chamber 70 surrounding the generally conical exhaust valve stem 50 also being generally conical. The housing 46 yet further comprises an exhaust tube 71 which is disposed to a side thereof remote from the valve block 44 and communicates with the chamber 70.

The valve block 44 includes a conical recess 72 which is an extension of the chamber 70 in the housing 46 and at the bottom of which is the exhaust valve seat 67. The valve block 44 further includes a fluid passageway 73 therein which includes a first, inlet opening 74 which communicates with the second opening 22 of the passageway 20 in the main body 4 and a second, outlet opening 75 at the exhaust valve seat 67.

Figure 5:
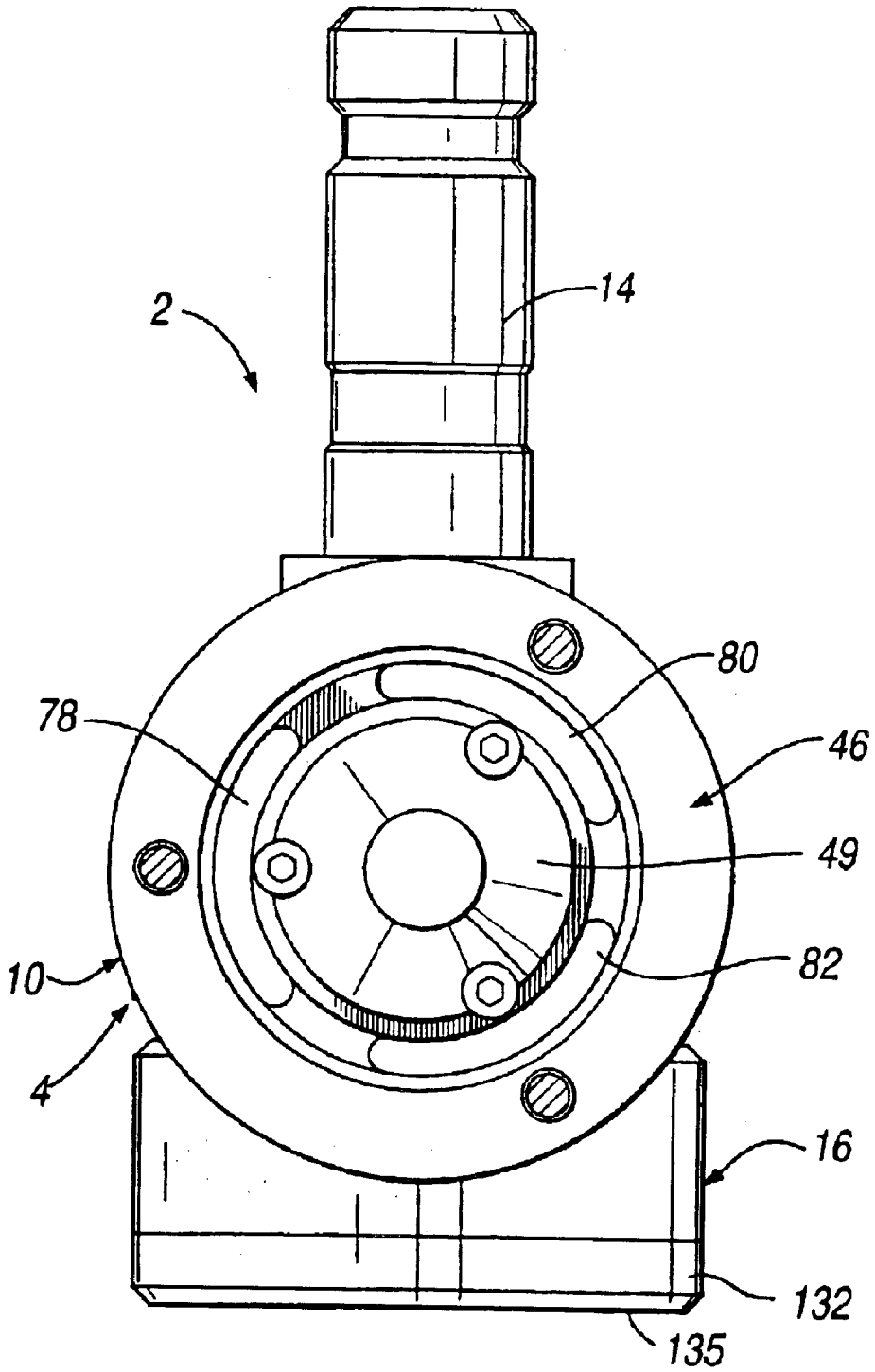
FIG. 5 illustrates an end view of the filling head of FIG. 1, illustrated with part of the housing of the exhaust actuator removed.

In order to provide the required mounting for the support sleeve 49, the chamber 70 in the housing 46 is divided into three arcuate chamber parts 78, 80, 82 in the vicinity of the mounting of the exhaust valve assembly 48 (as illustrated in FIG. 5). In this embodiment the three arcuate chamber parts 78, 80, 82 are substantially equal in circular length.

The chamber 70 is configured principally to be exhausted with an exhaust gas passing from the valve block 44. In this embodiment the valve block 44 includes a plurality of first exhaust gas inlet passages 84 which surround the outlet opening 75 at the exhaust valve seat 67. The first exhaust gas inlet passages 84 include respective outlets 86 which define an array, preferably a circular array, around the exhaust valve seat 67, with the array being axially centred on a common axis of the exhaust valve stem 50, the exhaust valve seat 67 and the passageway 73. At least those portions of the first exhaust gas inlet passages 84 which define the outlets 86 are parallel to the passageway 73. In this embodiment the outlets 86 are formed in the surface of the conical recess 72 in the valve block 44 and are located downstream, with reference to the direction of flow through the chamber 70, of the outlet opening 75 of the passageway 73. The valve block 44 further includes an annular chamber 88 in an outer surface thereof which commonly connects the first exhaust gas inlet passages 84 and which is in communication with a conduit 90 in the main body 4 for supplying a source of an exhaust gas thereto. In this embodiment the conduit 90 is directed radially to the annular chamber 88, but in an alternative embodiment could be directed tangentially.

The chamber 70 is further configured to be exhausted with an exhaust gas passing through the housing 46. In this embodiment the housing 46 includes a plurality of second and third exhaust gas inlet passages 92, 93 downstream of the first exhaust gas inlet passages 84. The second and third exhaust gas inlet passages 92, 93 include respective outlets 94, 95 which define an array, preferably a circular array, around the exhaust valve seat 67 and communicate with the chamber 70. At least those portions of the second and third exhaust gas inlet passages 92. 93 which include the outlets 94, 95 are parallel to the first exhaust gas inlet passages 84, and thus also parallel to the passageway 73 in the valve block 44. The housing 46 includes an annular chamber 96 which commonly connects the second and third exhaust gas inlet passages 92, 93 and a conduit 98 in communication with the chamber 96 for supplying a source of an exhaust gas thereto.

The slide body 16 is mounted for vertical sliding movement relative to the main body 4 by first and second spaced biasing elements 100, in this embodiment compression springs, disposed therebetween. Each of the biasing elements 100 is mounted on a respective threaded member 102, both of which threaded members 102 connect the slide body 16 to the main body 4. In the normal or inoperative configuration, the slide body 16 is biased by the biasing elements 100 downwardly away from the main body 4 so as to be separated therefrom by a gap 103.

The slide body 16 includes a bore 104 for slideably receiving in mating relationship the downwardly-extending part 5 of the main body 4. The slide body 16 further includes a projection 105 on the upper surface 106 thereof which is complementary to a corresponding recess 107 formed in the lower surface 6 of the main body 4 around the downwardly-extending part 5. The bore 104 includes an annular seal 109 which surrounds the downwardly-extending part 5 so as to form a fluid tight seal therebetween. The lower, distal end 110 of the downwardly-extending part 5 is provided thereunder with an annular valve stem seal 112 which includes a central opening 113 which is aligned with the passageway 20 in the main body 4, the inner and outer diameters of the valve stem seal 112 substantially corresponding respectively to the inner diameter of the third opening 25 in the passageway 20 and the inner diameter of the bore 104. The bore 104 defines a chamber 116 which is configured to have an inner diameter that is larger than the outer diameter of the valve stem of the container to be filled. The chamber 116 includes a main, upper section 122 and lower section 123 which is of slightly smaller diameter than the upper section 122 and defines an opening 124 through which the valve stem of the container to be filled extends. The slide body 16 yet further includes a conduit 126 which is in communication with the chamber 116. The slide body 16 further comprises an annular head seal 131 which is located below and surrounds the opening 124 to the chamber 116. The head seal 131 is retained in a central opening 133 in a seal retaining block 132 which provides the lower part of the slide body 16. The seal retaining block 132 includes a downwardly-extending recess 134 in a lower surface 135 thereof for receiving the head of a container to be filled.

Figure 7:
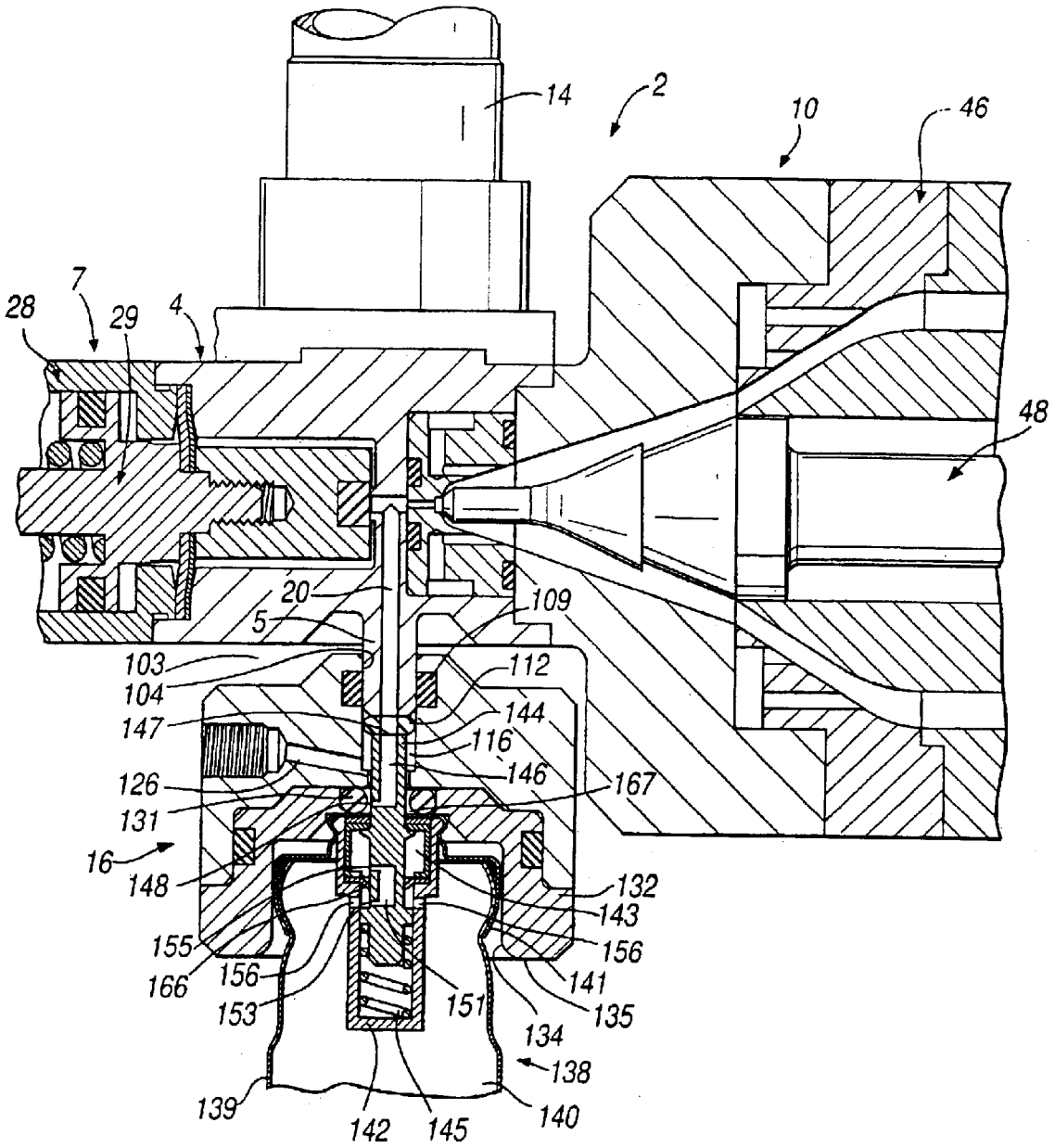
FIGS. 7 to 13 illustrate enlarged part-sectional side views of part of the filling head of FIG. 1 in a series of respective positions representing successive sequential steps in a container filling operation.
Figure 8:
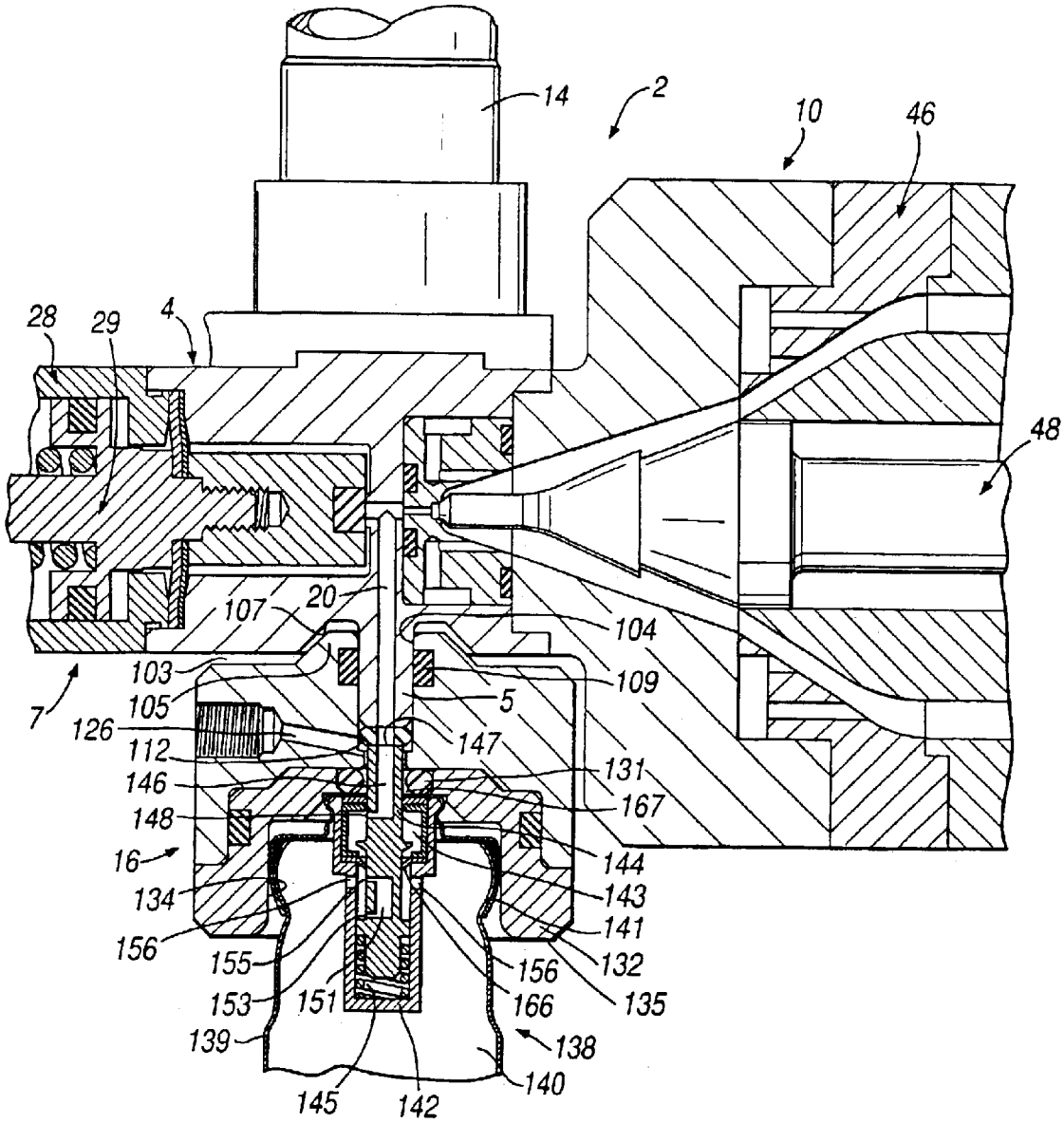

As illustrated in FIG. 7, in this embodiment a container 138 to be filled by the filling head 2 comprises a body 139 which defines a storage chamber 140 for holding a suspension or solution of a pharmaceutical substance in a propellant under pressure. The body 139 includes a head 141 which includes a peripheral housing 142 that defines a metering chamber 143 and a valve stem 144 that is movably disposed in the housing 142 and extends from the head 141. The valve stem 144 is movable between an extended position (as illustrated in FIG. 7) and a depressed position (as illustrated in FIG. 8), the valve stem 144 normally being biased by a compression spring 145 into the extended position. The valve stem 144 includes an L-shaped conduit 146 which extends between a first, outlet opening 147 located at the distal end of the valve stem 144 and a second, inlet opening 148 located in the lateral wall of the valve stem 144. The valve stem 144 further includes a U-shaped conduit 151 in that part thereof which is always disposed within the container 138. The U-shaped conduit 151 includes first and second axially-spaced openings 153, 155 located in the lateral wall of the valve stem 144 and enables communication between the metering chamber 143 and the storage chamber 140 of the container 138 via bores 156 in the housing 142.

When the valve stem 144 is in the extended position (as illustrated in FIG. 7), the inlet opening 148 of the L-shaped conduit 146 is located outside the body 139 of the container 138, and in particular remote from the metering chamber 143 within the container 138. Thus, when the valve stem 144 is in the extended position, the container 138 is closed since there is no communication path between the storage chamber 140 and the L-shaped conduit 146 in the valve stem 144. In the extended position, the U-shaped conduit 151 communicates via the first opening 153 and the bores 156 in the housing 142 with the storage chamber 140 and via the second opening 155 with the metering chamber 143. In this position, with the container 138 inverted, the metering chamber 143 is filled.

When the valve stem 144 is in the depressed position (as illustrated in FIG. 8), that is, one of either a fill position or a discharge position, the valve stem 144 is pushed down against the biasing action of the biasing element 145, thereby to move the inlet opening 148 of the L-shaped conduit 146 into communication with the metering chamber 143 and the U-shaped conduit 151 out of communication with the metering chamber 143 and solely in communication with the storage chamber 140 via the bores 156 in the housing 142. In a filling operation, a solution or suspension of a pharmaceutical substance in a propellant under pressure is forced downwardly through the L-shaped conduit 146, through the metering chamber 143 and into the storage chamber 140 of the container 138 by being forced past an annular seal 166 which surrounds the valve stem 144 at the bottom of the metering chamber 143. During the discharge of a metered volume of a suspension or solution of a pharmaceutical substance in propellant under pressure from the container 138, the metered volume of suspension or solution present in the metering chamber 143 is permitted to flow outwardly through the L-shaped conduit 146 by the provision of a communication path between the metering chamber 143 and the inlet opening 148 of the L-shaped conduit 146. In the discharge operation, the seal 166 prevents any further of the suspension or solution in the storage chamber 140 from entering the metering chamber 143 so that a precise volume is discharged.

In this embodiment the principal structural components of the filling head 2 are typically composed of stainless steel and the seals are typically composed of nitrile rubber. The only exceptions are the diaphragm seals and the seals which come into contact with propellant which typically are composed of PTFE and the valve block 44 and the exhaust valve stem 50 which are typically composed of hardened stainless steel.

Figure 6:
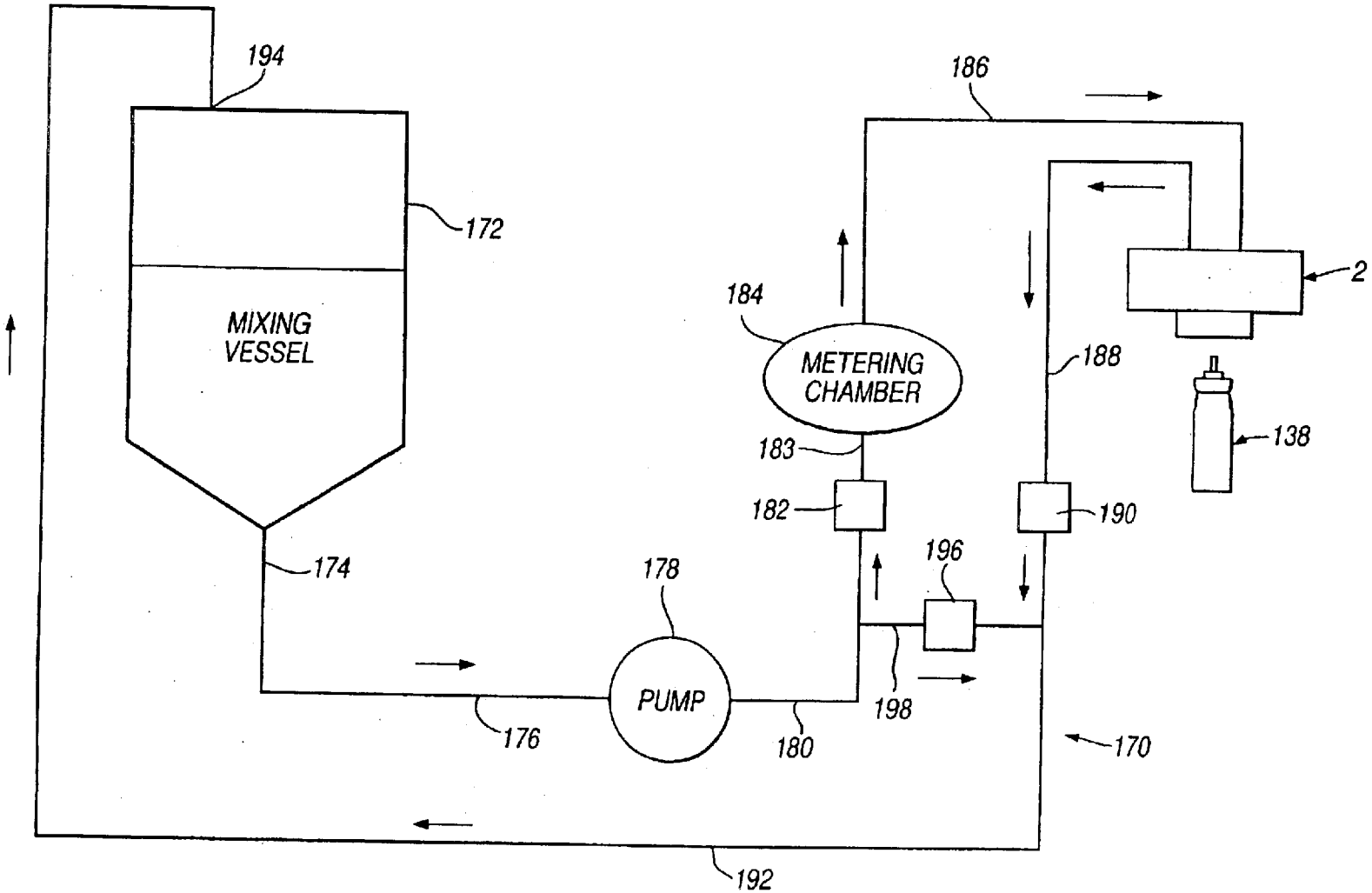
FIG. 6 illustrates a schematic representation of a filling system in accordance with a preferred embodiment of the present invention for introducing into a container a suspension or solution of a pharmaceutical substance in a propellant under pressure, with the system incorporating the filling head of FIG. 1.

FIG. 6 illustrates a filling system which incorporates the above-described filling head 2 for filling a container 138 with a metered volume of a suspension or solution of a pharmaceutical substance in a propellant under pressure.

The filling head 2 is included in a circulatory line, designated generally by reference sign 170, in which a propellant under pressure containing a pharmaceutical substance in a suspension or solution is circulated. The circulatory line 170 includes a mixing vessel 172 which holds propellant containing pharmaceutical substance in a suspension or solution. The mixing vessel 172 is pressurised, as is the remainder of the circulatory line 170, so that the propellant is not only under pressure, but is also maintained as a liquid where the boiling point of the propellant is lower than the ambient temperature. A line 176 connects an outlet 174 of the mixing vessel 172 to a pump 178, which pump 178 is provided to pump propellant around the circulatory line 170. Another line 180 connects the pump 178 to the inlet side of an inlet valve 182. A further line 183 connects the outlet side of the inlet valve 182 to a metering chamber 184. The metering chamber 184 is configured to receive a metered volume of the propellant containing pharmaceutical substance in a suspension or solution on opening of the inlet valve 182. The metered volume corresponds to the volume which is required to be introduced into the container 138 by the filling head 2. A yet further line 186 connects the metering chamber 184 to the filling head 2, specifically the inlet conduit 34 in the main body 4 of the filling head 2. As described hereinabove, the inlet conduit 34 communicates with the chamber 31 surrounding the filling valve stem 30 and thence with the outlet conduit 35. A still further line 188 connects the filling head 2, specifically the outlet conduit 35 in the main body 4 of the filling head 2, to the inlet side of an outlet valve 190. A still yet further line 192 connects the outlet side of the outlet valve 190 to an inlet 194 of the mixing vessel 172, thereby completing the circulatory line 170. The filling system further includes a bypass valve 196 which is provided in a line 198 connected between the inlet side of the inlet valve 182 and the outlet side of the outlet valve 190.

The operation of the filling head 2 in filling a container 138 with a metered volume of a suspension or solution of a pharmaceutical substance in a propellant under pressure and subsequently exhausting residual propellant under pressure containing pharmaceutical substance will now be described hereinbelow with reference to FIGS. 6 to 13.

In a first step, as illustrated in FIG. 7, the head 141 of a container 138 to be filled is located within the downwardly-extending recess 134 in the seal retaining block 132 of the slide body 16. In this position, the head 141 of the container 138 bears against the head seal 131 and the distal end of the valve stem 144 of the container 138 bears against the valve stem seal 112, with the valve stem 144 being urged into the extended position by the biasing element 145. In this way, the chamber 116 is sealed by the valve stem and head seals 112, 131. Although not illustrated, it will be understood that the bottom of the container 138 is supported and urged upwardly. Further, in this position, the biasing elements 100 urge the slide body 16 away from the main body 4 so as to provide the gap 103 therebetween, and both the filling valve assembly 29 and the exhaust valve assembly 48 are closed.

In a second step, as illustrated in FIG. 8, the actuating mandrel 14 is operated upon to move the main body 4 and both the fill actuator 7 and the exhaust actuator 10 disposed thereto downwardly relative to the slide body 16 against the bias of the biasing elements 100. This movement causes the projection 105 to pass into the recess 107 and the gap 103 to be closed. Additionally, the downwardly-extending part 5 of the main body 4 is urged via the valve stem seal 112 against the distal end of the valve stem 144 of the container 138, thereby to push the valve stem 144 downwardly to the depressed open position in which the inlet opening 148 of the L-shaped conduit 146 in the valve stem 144 is in communication with the metering chamber 143 of the container 138 and the U-shaped conduit 151 in the valve stem 144 is located solely in communication with the storage chamber 140 of the container 138 and out of communication with the metering chamber 143.

Figure 9:
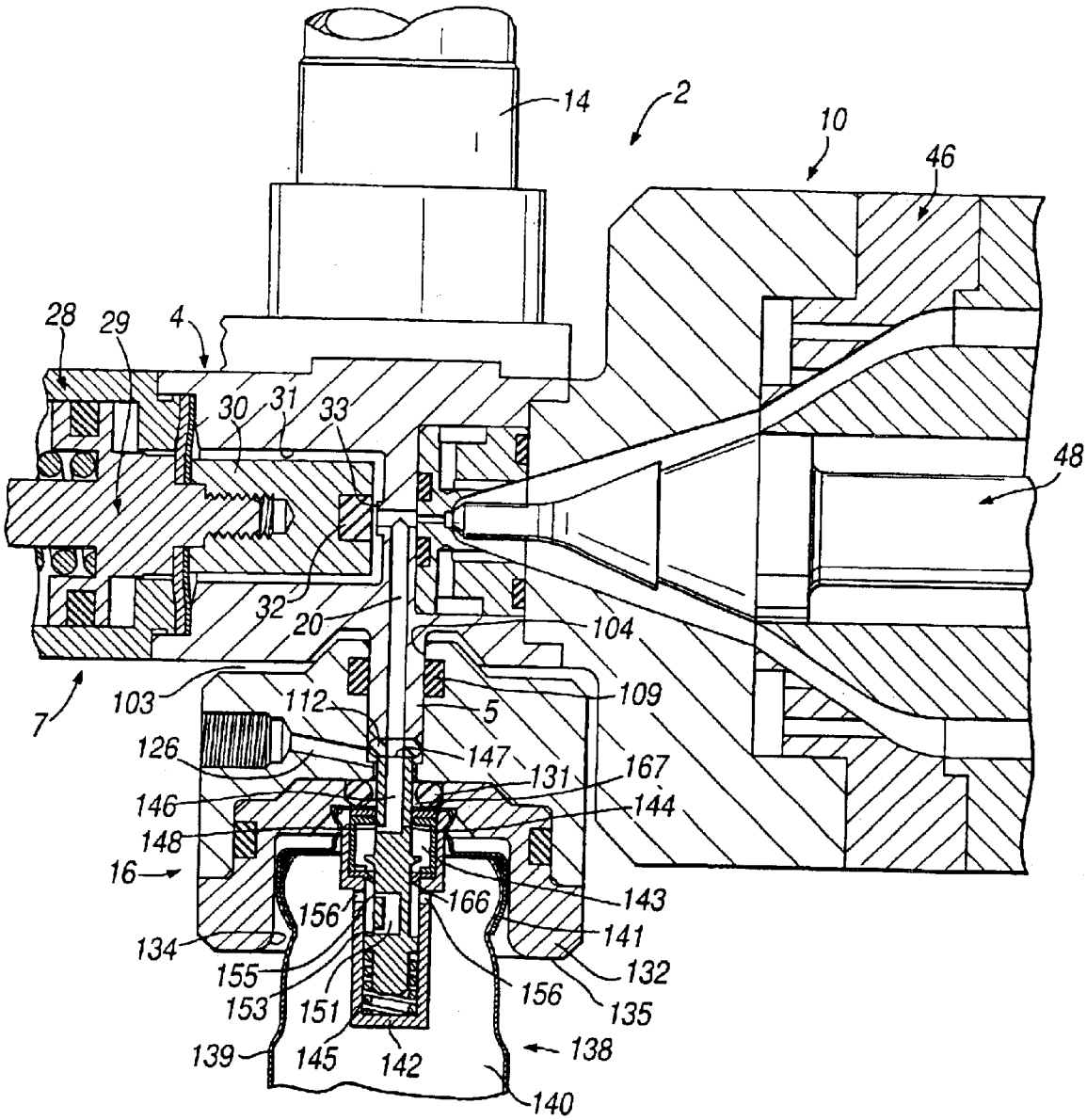

In a third step, as illustrated in FIG. 9, the filling valve assembly 29 is opened by retracting the valve sealing end 32 of the filling valve stem 30 from the valve seat 33. A metered volume of propellant containing pharmaceutical substance in suspension or solution present in the metering chamber 184 is then introduced through the inlet conduit 34, through the annular chamber 31, through the passageway 20, through the L-shaped conduit 146 in the valve stem 144, through the metering chamber 143 of the container 138 and finally past the seal 166 into the storage chamber 140 of the container 138 via the bores 156 in the housing 142.

Prior to opening of the filling valve assembly 29, the inlet valve 182 and the outlet valve 190 in the circulatory line 170 are closed. When the inlet valve 182 and the outlet valve 190 are closed, the line 183 connecting the inlet valve 182 to the metering chamber 184, the metering chamber 184, the line 186 connecting the metering chamber 184 to the filling head 2 and the line 188 connecting the filling head 2 to the inlet side of the outlet valve 190 are full of propellant containing pharmaceutical substance in suspension or solution. When the metering chamber 184 is emptied a volume of propellant under pressure containing pharmaceutical substance corresponding to that metered by the metering chamber 184 is passed through the line 186 and into the filling head 2 through the inlet conduit 34. In this way, a precisely metered volume of propellant containing pharmaceutical substance in suspension or solution is introduced into the container 138. In order that the pump 178 can continue to operate continuously, thereby continuing to circulate the propellant containing pharmaceutical substance around the circulatory line 170, when the inlet valve 182 and the outlet valve 190 are closed, the bypass valve 196 is open.

Figure 10:
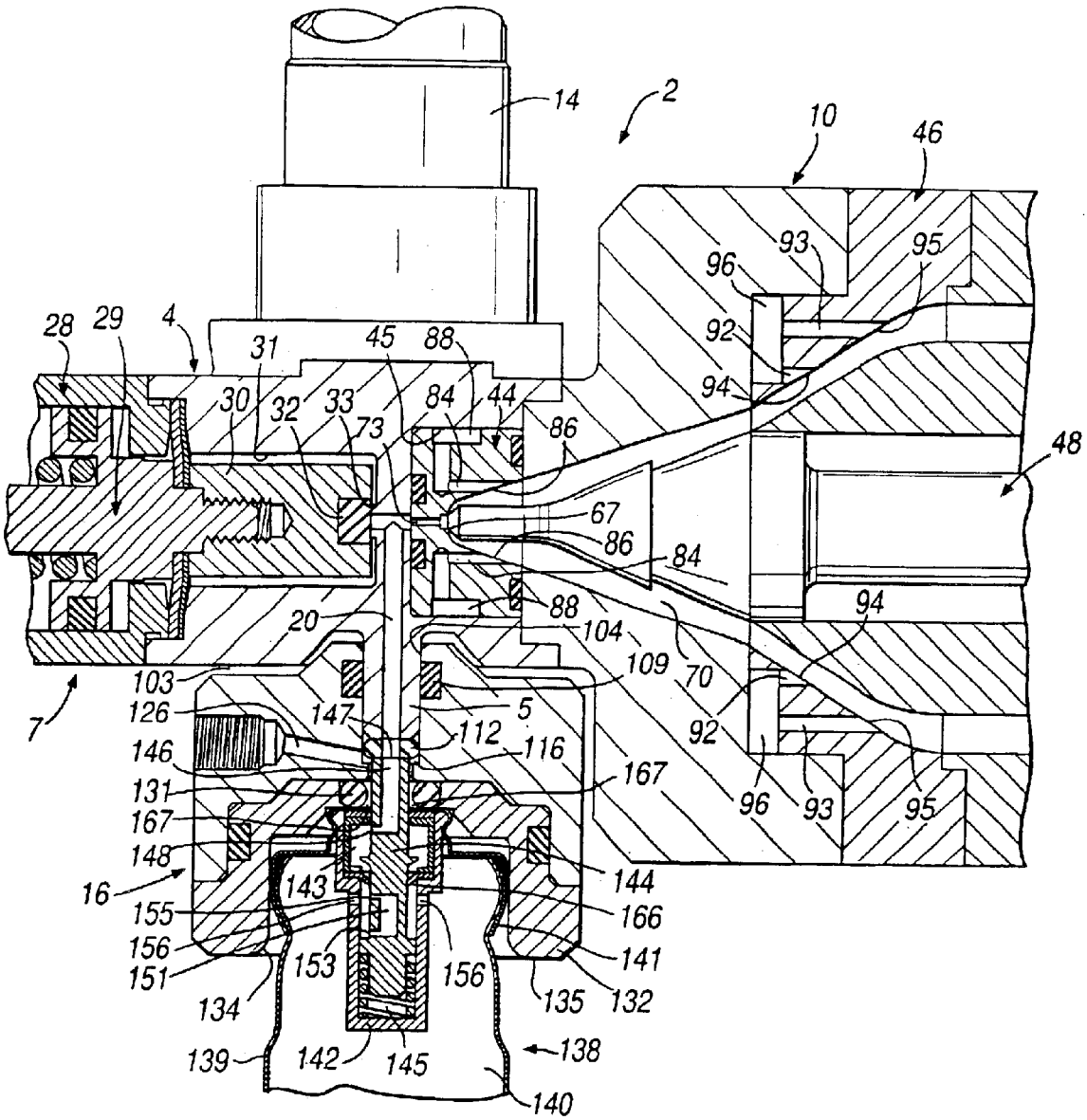

In a fourth step, as illustrated in FIG. 10, after a metered volume of propellant containing pharmaceutical substance in suspension or solution has been introduced into the container 138, the filling valve assembly 29 is closed by biasing the valve sealing end 32 of the filling valve stem 30 against the valve seat 33. Thereafter, two separate operations are commenced in order to obviate the inadvertent release of propellant containing pharmaceutical substance into the atmosphere at the end of the filling operation.

In a first operation a pressurized fluid is supplied to the conduit 126 in the slide body 16. This fluid provides a sealing jacket in the chamber 116 and the space 167 defined between the inner circumference of the head seal 131 and the lateral wall of the valve stem 144 of the container 138. This fluid is supplied at a pressure higher than the vapour pressure of the propellant under pressure containing pharmaceutical substance which remains in the passageway 20 in the main body 4 and the valve stem 144 of the container 138. In a preferred embodiment the fluid is a gas. Preferably, the gas is one of air or nitrogen.

In a second operation an exhaust gas, preferably one of air or nitrogen, is introduced under pressure into the chamber 70 in the exhaust actuator 10 via the first, second and third exhaust gas inlet passages 84, 92, 93. The exhaust gas is preferably heated to a temperature of at least about 35° C., more preferably from 35 to 50° C., in order to prevent any of the propellant containing pharmaceutical substance which is exhausted through the chamber 70 from re-liquefying therein. Typically, where air is used as the exhaust gas, the mass flow rate is in the range of from 0.1 to 10 grams/second, preferably around 2 grams/second.

Figure 11:
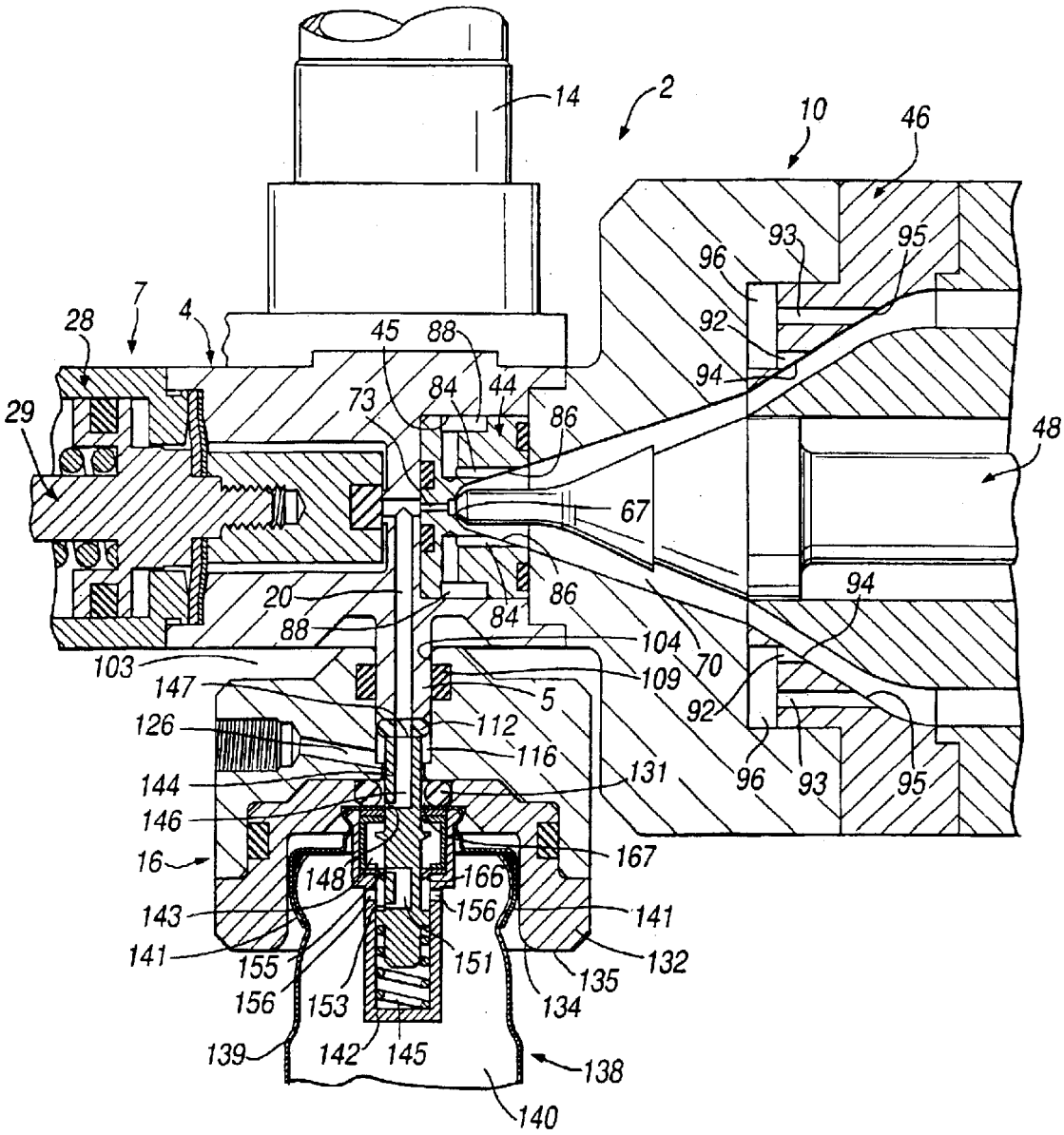

In a fifth step, as illustrated in FIG. 11, the actuating mandrel 14 is partially raised thereby partially releasing the valve stem 144 of the container 138 to an intermediate position between the extended closed position (as illustrated in FIG. 7) and the depressed open position (as illustrated in FIG. 8). In this intermediate position, the inlet opening 148 of the L-shaped conduit 146 in the valve stem 144 of the container 138 is raised so as not to be in communication with the metering chamber 143 of the container 138 but with the space 167 defined between the inner circumferential surface of the head seal 131 and the lateral wall of the valve stem 144 of the container 138 and the chamber 116 in communication therewith. The propellant under pressure containing pharmaceutical substance which is present in the L-shaped conduit 146 in the valve stem 144 and the passageway 20 in the main body 4 is prevented from escaping therefrom via the inlet opening 148 in the valve stem 144 as a result of the overpressure of the fluid supplied via the conduit 126. Thus, following the filling operation, and while the valve stem 144 of the container 138 is still in communication with the filling head 2, the provision of a sealing jacket of a pressurised fluid around the part of the valve stem 144 which includes the L-shaped conduit 146 prevents the propellant under pressure containing pharmaceutical substance which remains in the L-shaped conduit 146 in the valve stem 144 and the passageway 20 in the main body 4 from escaping through the inlet opening 148 in the valve stem 144, which propellant containing pharmaceutical substance would otherwise be subsequently released to the atmosphere following the removal of the container 138 from the filling head 2.

When the valve stem 144 is in this intermediate position, the metering chamber 143 of the container 138 is closed to the atmosphere since the L-shaped conduit 146 in the valve stem 144 does not communicate with the metering chamber 143 but rather only to the outside of the container 138, and in particular with the space 167 defined between the inner circumferential surface of the head seal 131 and the lateral wall of the valve stem 144 and the chamber 116 in communication therewith. By providing the valve stem 144 in this intermediate position, propellant under pressure containing pharmaceutical substance present in the metering chamber 143 cannot escape therefrom and therefore only the propellant containing pharmaceutical substance present in the L-shaped conduit 146 in the valve stem 144 and the passageway 20 in the main body 4 need be exhausted. The provision of a sealing jacket of overpressure fluid about the part of the valve stem 144 which includes the inlet opening 148 following the filling operation and during the exhaust operation further advantageously provides that, when the container 138 is ultimately removed from the filling head 2 (in the final step following the step as illustrated in FIG. 13), no residual propellant containing pharmaceutical substance can escape from the L-shaped conduit 146 in the valve stem 144 or the passage way 20 in the main body 4 prior to exhaustion thereof through the exhaust actuator 10.

Figure 12:
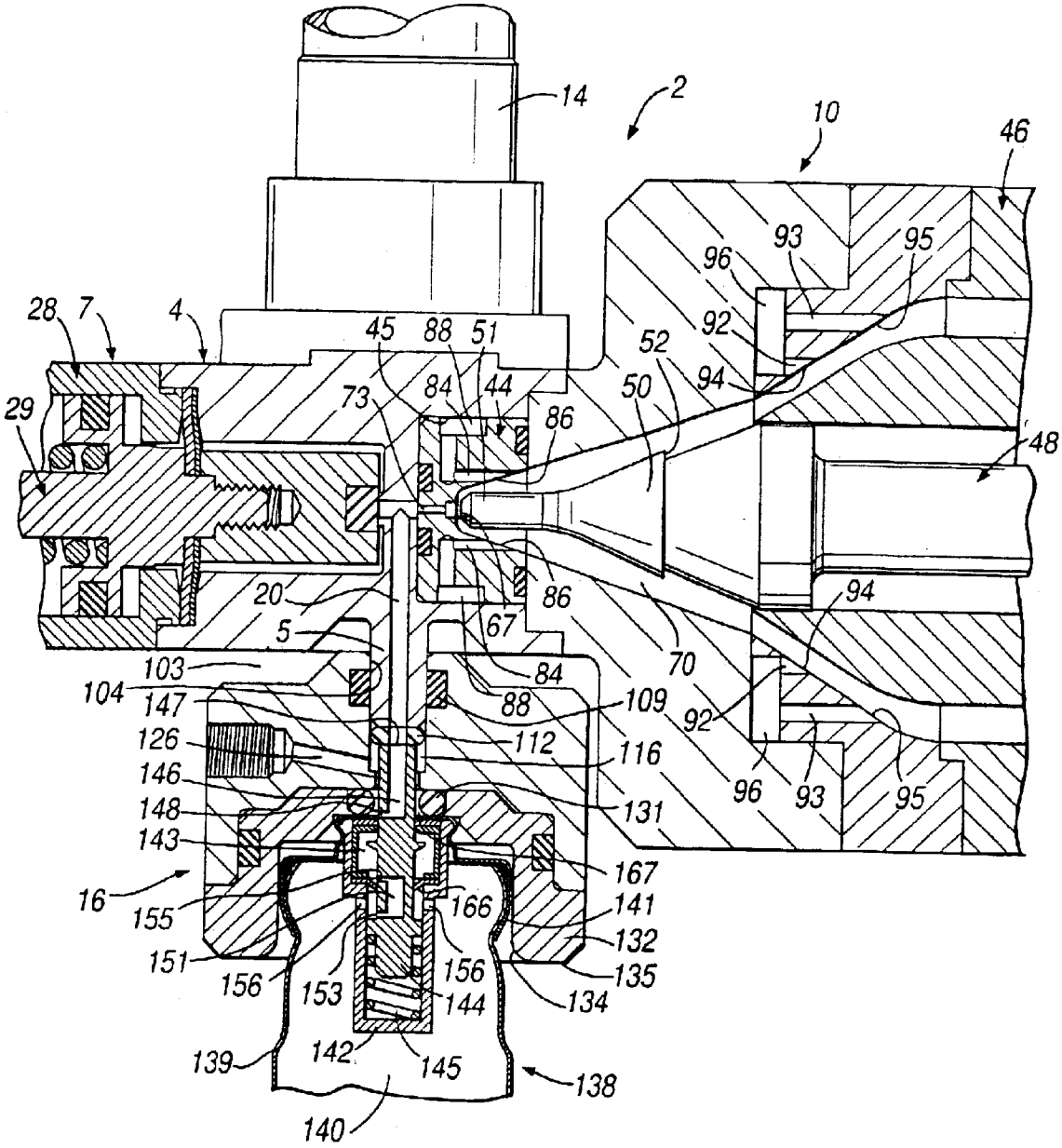

In a sixth step, as illustrated in FIG. 12, the exhaust valve assembly 48 is opened by retraction of the valve sealing end 51 of the exhaust valve stem 50 from the exhaust valve seat 67. In this way, a communication path is provided between the L-shaped conduit 146 in the valve stem 144, the passageway 20 in the main body 4 and the chamber 70 in the exhaust actuator 10. The release of pressure from the propellant containing pharmaceutical substance on opening of the exhaust valve assembly 48 causes the propellant to boil off as a gas and escape through the passageway 73 in the valve block 44 into the chamber 70. In this way, both the propellant and the pharmaceutical substance contained therein escape from the L-shaped conduit 146 in the valve stem 144 and the passageway 20 in the main body 4 into the chamber 70. The provision of exhaust gas flows through the first, second and third exhaust gas inlet passages 84, 92, 93 create parallel flows to the gas escaping from the passageway 73 in the valve block 44. This configuration creates substantially aligned flows between on the one hand the now gaseous propellant entraining pharmaceutical substance escaping from the passageway 73 in the valve block 44 and on the other hand the exhaust gas flows through the first, second and third exhaust gas inlet passages 84, 92, 93 downstream thereof. This configuration provides a uniform flow of gas in the chamber 70 which entrains the propellant and the pharmaceutical substance that escapes from the passageway 20 in the main body 4 and the L-shaped conduit 146 in the valve stem 144. Preferably, the mass flow rate of the exhaust gas is at least 10 times the peak mass flow rate of the gaseous propellant flowing into the chamber 70 when the propellant boils off. In a preferred embodiment a vacuum pump incorporating a filter is connected to the exhaust tube 71 so as to collect the escaping pharmaceutical substance.

Figure 13:
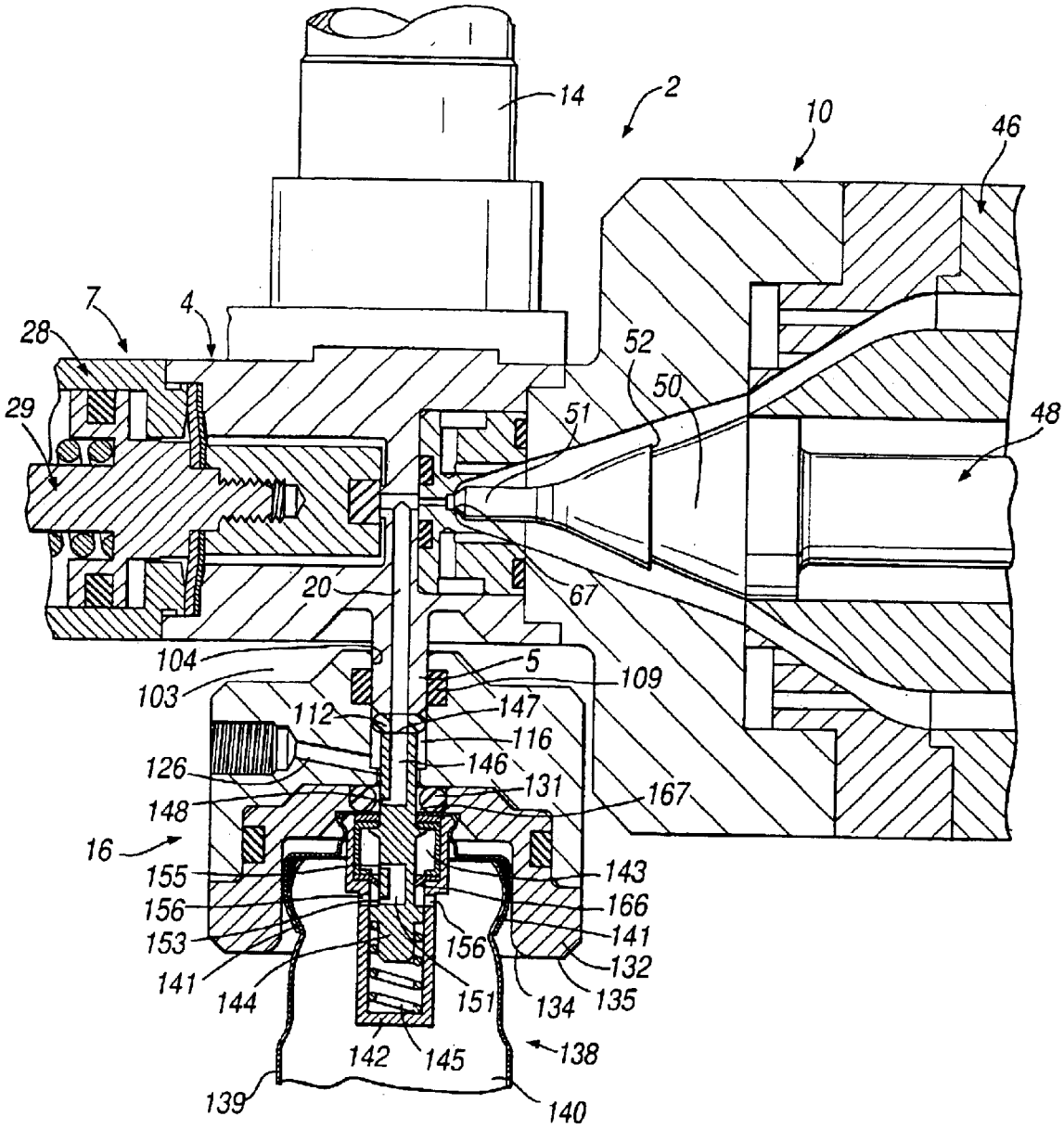

In a seventh step, as illustrated in FIG. 13, the exhaust valve assembly 48 is closed by urging the valve sealing end 51 of the exhaust valve stem 50 against the exhaust valve seat 67, the fluid supplied to the conduit 126 in the slide body 16 to provide a sealing jacket around the part of the valve stem 144 which includes the inlet opening 148 is terminated and the exhaust gas supplied to the first, second and third exhaust gas inlet passages 84, 92, 93 is terminated. The actuator mandrel 14 is raised, thereby to raise again the filling head 2 relative to the container 138 so that the slide body 16 is spaced by the normal gap from the main body 4. In this way, the valve stem 144 is raised from the intermediate position to the extended position, thereby to provide the metering chamber 143 of the container 138 in communication via the U-shaped conduit 151 in the valve stem 144 with the storage chamber 140 of the container 138.

In a final step the container 138 is removed from the filling head 2 without inadvertent leakage of propellant and pharmaceutical substance to the atmosphere. The filling head 2 is then ready for the next filling cycle for a subsequent container.

Finally, it will be understood by a person skilled in the art that the present invention has been described in its preferred embodiment and can be modified in many different ways without departing from the scope of the invention as defined in the appended claims.

What is claimed is:

1. A filling apparatus for introducing into a container a suspension or solution of a substance, in particular a pharmaceutical substance, in a propellant under pressure, comprising:

a main body including a passageway for communicating, in use, with a valve stem extending from a head of a body of a container, the container comprising a metering chamber selectively communicatable by the valve stem with the atmosphere and a storage chamber defined by the body;

a fill actuator comprising a filling valve assembly in communication with the passageway for selectively introducing thereinto propellant under pressure containing a substance in a suspension or solution;

an exhaust actuator comprising an exhaust valve assembly in communication with the passageway for selectively exhausting therefrom propellant under pressure containing substance; and a container-engaging body in communication with the passageway for receiving, in use, the head of the body of the container, the container-engaging body being movable relative to the main body so as thereby to cause the valve stem of the container to be selectively positioned in an extended closed position, a depressed open position or an intermediate position therebetween, in which intermediate position the metering chamber of the container is closed to the atmosphere said container engaging body including an annular seal disposed about a lower end of the chamber against which, in use, is abutted against the head of the body of the container which surrounds the valve stem thereof.

2. The filling apparatus according to claim 1, further comprising biasing means for biasing the container-engaging body away from the main body.

3. The filling apparatus according to claim 2, wherein the biasing means comprises at least one compression spring disposed between the main body and the container-engaging body.

4. The filling apparatus according to claim 1, wherein the main body includes an outwardly-extending part through which the passageway extends and which is sealingly received within a bore in the container-engaging body.

5. The filling apparatus according to claim 4, further comprising an annular seal disposed at the distal end of the outwardly-extending part of the main body, which seal is, in use, abutted by the distal end of the valve stem of the container.

6. The filling apparatus according to claim 1, wherein the container-engaging body includes a chamber of greater radial dimension than the valve stem of the container into which, in use, extends the valve stem of the container and a conduit in communication with the chamber for feeding a pressurised fluid thereto.

7. The filling apparatus according to claim 1, wherein the annular seal comprises an O-ring.

8. The filling apparatus according to claim 1, wherein opposing surfaces of the main body and the container-engaging body include one or the other of at least one projection and at least one recess , whereby, when the main body and the container-engaging body are moved together, the at least one projection is engaged within the at least one recess.

9. A filling system for introducing into a container a suspension or solution of a substance, in particular a pharmaceutical substance, in a propellant under pressure incorporating the filling apparatus according to claim 1.

10. A method of introducing into a container a suspension or solution of a substance, in particular a pharmaceutical substance, in a propellant under pressure, comprising the steps of:

providing a container comprising a body defining a storage chamber , a valve stem extending from a head of the body and a metering chamber selectively communicatable by the valve stem with the atmosphere and the storage chamber , the valve stem having an outlet opening and a lateral inlet opening and being movable between an extended closed position in which the lateral inlet opening is located outside the body and a depressed open position in which the lateral inlet opening is located within the body;

sealing the head of the body of the container which surrounds the valve stem thereof from ambient atmosphere; communicating the outlet opening of the valve stem of the container with a passageway in a main body of a filling apparatus ,the filling apparatus comprising a fill actuator comprising a filling valve assembly for selectively introducing into the passageway propellant under pressure containing a substance, in particular a pharmaceutical substance, in a suspension or solution and an exhaust actuator comprising an exhaust valve assembly for selectively exhausting from the passageway propellant under pressure containing substance; depressing the valve stem of the container so as to provide a communication path to the storage chamber thereof;

opening the filling valve assembly thereby to fill the storage chamber of the container with propellant under pressure containing a substance, in particular a pharmaceutical substance, in a suspension or solution;

closing the filling valve assembly;

moving the valve stem of the container to an intermediate position between the depressed open position and the extended closed position, in which intermediate position the metering chamber of the container is closed to the atmosphere and the lateral inlet opening in the valve stem of the container is located outside the body thereof; and opening the exhaust valve assembly to enable propellant under pressure containing substance in the passageway and the valve stem of the container to exhaust.

11. The method according to claim 10, wherein the filling apparatus further comprises a container-engaging body which is movably disposed to the main body thereof and is adapted to receive the head of the body of the container which includes the valve stem thereof, and further comprising the step of biasing the container-engaging body away from the main body of the filling apparatus.

12. The method according to claim 11, wherein the main body of the filling apparatus includes an outwardly-extending part through which the passageway extends and which is sealingly received within a bore in the container-engaging body.

13. The method according to claim 12, further comprising the step of sealing the distal end of the outwardly-extending part of the main body against the distal end of the valve stem of the container.

14. The method according to claim 10, further comprising the step of surrounding the part of the valve stem of the container which includes the lateral inlet opening and extends from the body of the container with a pressurised fluid at least when the exhaust valve assembly is opened to exhaust propellant under pressure containing substance from the passageway and the valve stem of the container.

15. The method according to claim 14, wherein the pressurised fluid is at a pressure greater than the vapour pressure of the propellant under pressure containing substance.

16. The method according to claim 14, wherein the fluid is a gas.

17. The method according to claim 16, wherein the gas is one of air or nitrogen.

* * * * *